US010087933B2

(12) United States Patent
Senbongi et al.

(10) Patent No.: US 10,087,933 B2
(45) Date of Patent: Oct. 2, 2018

(54) VANE PUMP

(71) Applicant: YAMADA MANUFACTURING CO., LTD., Kiryu-shi (JP)

(72) Inventors: Yuji Senbongi, Kiryu (JP); Takahiro Satou, Kiryu (JP)

(73) Assignee: YAMADA MANUFACTURING CO., LTD., Kiryu-Shi, Gunma (JP)

( * ) Notice: Subject to any disclaimer, the term of this patent is extended or adjusted under 35 U.S.C. 154(b) by 257 days.

(21) Appl. No.: 14/933,111

(22) Filed: Nov. 5, 2015

(65) Prior Publication Data

US 2016/0245286 A1 Aug. 25, 2016

(30) Foreign Application Priority Data

Feb. 24, 2015 (JP) ..... 2015-034611
May 13, 2015 (JP) ..... 2015-098627

(51) Int. Cl.

| | |
|---|---|
| ***F01C 1/344*** | (2006.01) |
| ***F04C 2/344*** | (2006.01) |
| ***F04C 18/344*** | (2006.01) |
| ***F04C 15/06*** | (2006.01) |
| ***F01C 21/18*** | (2006.01) |
| ***F01C 21/08*** | (2006.01) |
| *F04C 13/00* | (2006.01) |

(52) U.S. Cl.
CPC ..... *F04C 15/06* (2013.01); *F01C 21/0863* (2013.01); *F04C 2/3446* (2013.01); *F04C 13/002* (2013.01)

(58) Field of Classification Search
CPC ..... F04C 15/06; F01C 21/0863
USPC ..... 418/268, 75, 77, 82, 259, 260
See application file for complete search history.

(56) References Cited

U.S. PATENT DOCUMENTS 2,641,195 A * 6/1953 Ferris ..... F01C 21/0818 418/267
3,216,363 A * 11/1965 Snow ..... F16H 39/32 418/135
6,375,441 B1 * 4/2002 Ichizuki ..... F01C 21/0863 418/133
7,070,399 B2 * 7/2006 Konishi ..... F01C 21/0863 417/213
7,628,596 B2 * 12/2009 Staton ..... F01C 21/0863 418/133

FOREIGN PATENT DOCUMENTS

JP 2005-120894 A 5/2005

* cited by examiner

*Primary Examiner* — Deming Wan
(74) *Attorney, Agent, or Firm* — McGinn IP Law Group, PLLC.

(57) ABSTRACT

A first main back pressure supply port 55 and a first subsidiary back pressure supply port 56 are formed in a first sliding contact surface 5*a* of a first side member 5, the first main back pressure supply port 55 is formed in a groove shape in the first sliding contact surface 5*a*, and the first subsidiary back pressure supply port 56 communicates with the first subsidiary discharge port 54. A second main back pressure supply port 65 and a second subsidiary back pressure supply port 66 are formed in a second side member 6, the second main back pressure supply port 65 passes through the second side member in the axial direction and the second subsidiary back pressure supply port 66 is formed in a groove shape in a second sliding contact surface 6*a*.

13 Claims, 9 Drawing Sheets

Fig. 1A
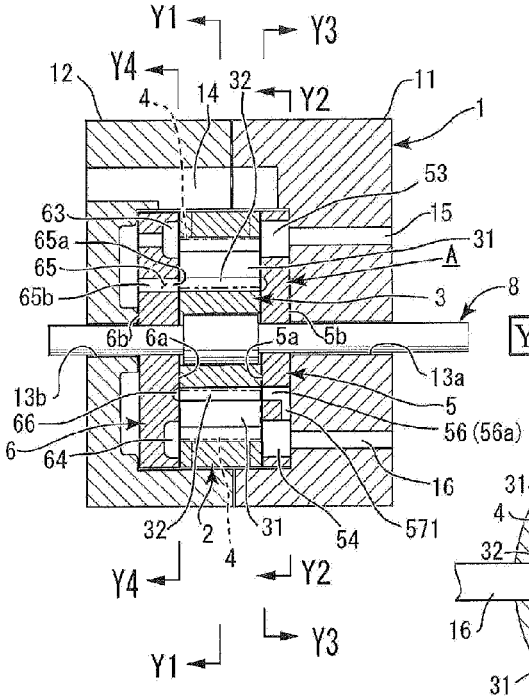
Fig. 1B
Y1-Y1 ARROW VIEW
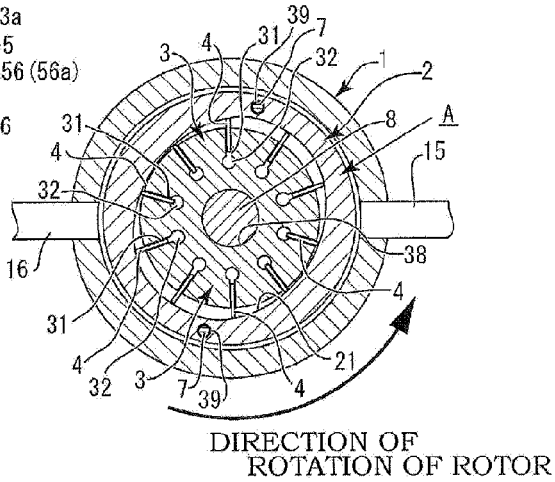
Fig. 1C
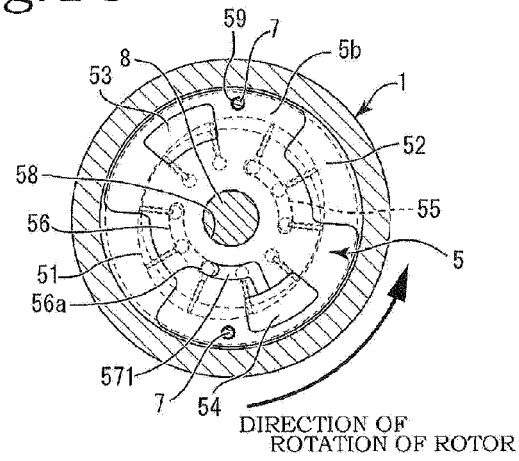
Y2-Y2 ARROW VIEW
Y3-Y3 ARROW VIEW
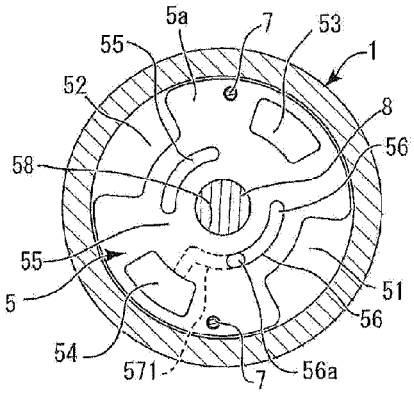
Fig. 1D

Y4-Y4 ARROW VIEW

Fig.9A
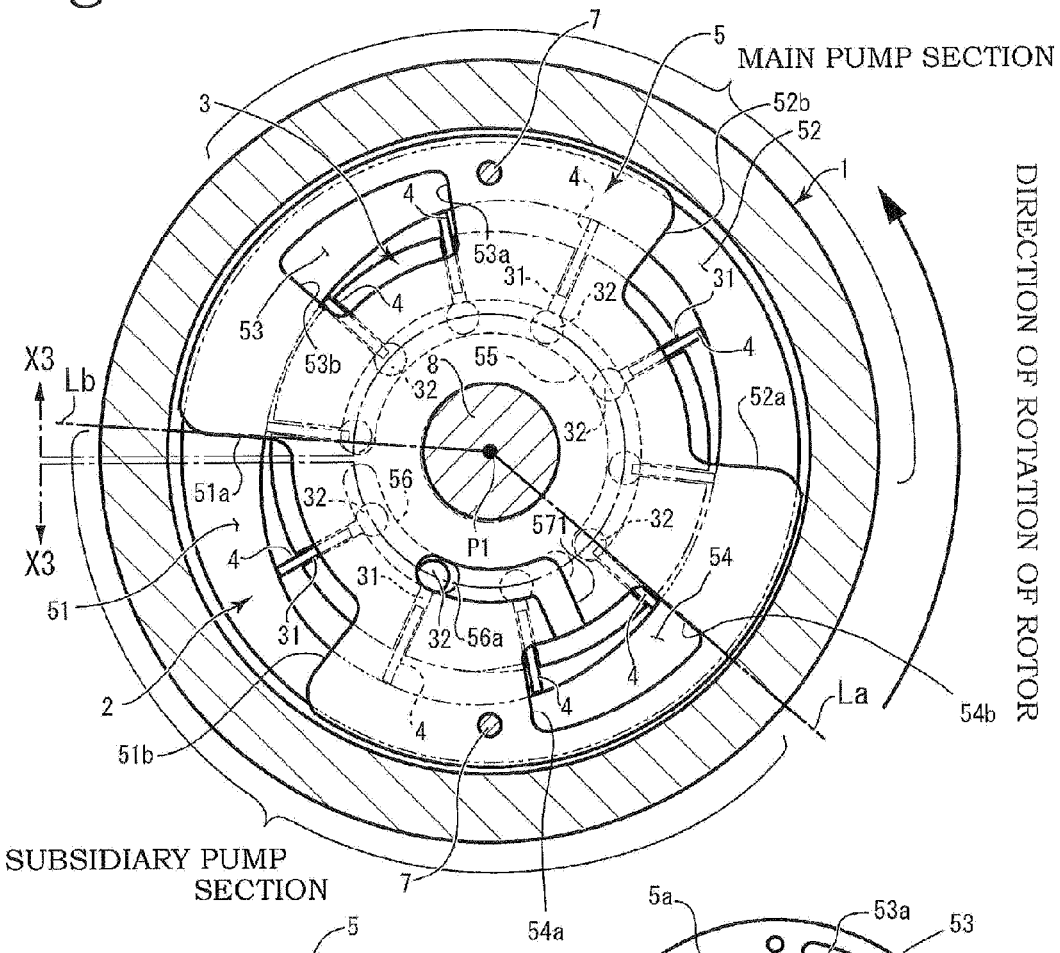
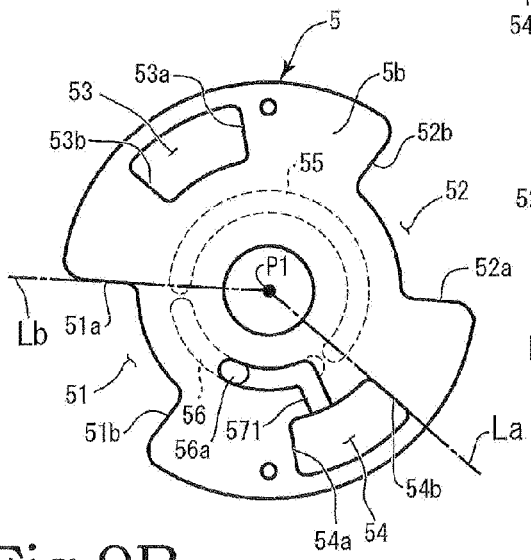
Fig.9B
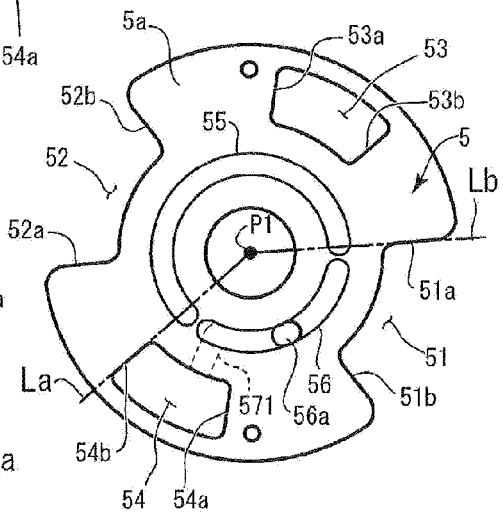
Fig.9C

VANE PUMP

BACKGROUND OF THE INVENTION

1. Field of the Invention

The present invention relates to a vane pump having a main discharge channel and a subsidiary discharge channel, capable of performing discharge from both the main discharge and subsidiary discharge channels when at low pressure and of performing discharge from the main discharge channel only when at high pressure, and capable of reducing the rotational resistance due to the vanes in a state of main discharge only at high pressure.

2. Description of the Related Art

There are vane pumps which have two discharge channels, and which switch to both or one of the channels by a control valve, when at low pressure and high pressure. Japanese Patent Application Publication No. 2005-120894 discloses a vane pump of this kind. The contents of Japanese Patent Application Publication No. 2005-120894 will be described briefly here. The numerals in brackets are those used in Japanese Patent Application Publication No. 2005-120894.

In the vane pump according to Japanese Patent Application Publication No. 2005-120894, intake and discharge is repeated two times during one revolution. In other words, a configuration in which there are two pumps (discharge sources) is achieved. There are two each of the intake ports (221, 222), discharge ports (231, 232) and discharge channels (25, 26), etc.

The intake channel (24) is one channel that is shared by two pumps. In order to distinguish the two pump configurations in the present description, the pump on the right hand-side which performs discharge without passing the spool valve (30) and which is illustrated in FIG. 12 in Patent Document 1 is defined as the main pump, and the pump on the left hand-side which performs discharge via the spool valve (30) and which is illustrated in FIG. 12 is defined as the subsidiary pump, for the sake of convenience.

In FIG. 12A of Japanese Patent Application Publication No. 2005-120894, oil discharged from the subsidiary pump on the left hand-side traverses the spool valve (30), and merges with the oil discharged from the main pump. Therefore, since the oil is discharged from both the main and subsidiary pumps, then it is possible to raise the discharge pressure. This is one example of an operation when the pump is below a prescribed speed of revolution.

In FIG. 12B of Japanese Patent Application Publication No. 2005-120894, a portion of the oil discharged from the left hand-side subsidiary pump is fed back via a communicating port (3*d*) and is returned to the intake channel (24). This is one example of an operation when the speed is equal to or above a prescribed speed of revolution. The main pump discharges oil at all times, throughout the speed range.

In Patent Document 1, furthermore, a back pressure chamber (11*d*) which constitutes a bottom portion of respective vane grooves (11*a*) is formed in a rotor (11), and a high-pressure chamber (70) (see FIG. 2) is formed between a bottom wall (2*c*) which is a portion of a cover (2) and a second side plate (14), whereby a portion of the operating oil discharged from the pump chamber (18) is introduced therein via respective second back pressure supply channels (71, 72) formed in the second side plate (14).

After operating the vane pump (P), the operating oil in the high-pressure chamber (70) is guided via the second back pressure supply channels (71, 72) to the back pressure chamber (11*d*) as back pressure operating oil, and due to the back pressure of this back pressure operating oil acting on the back surface (12*e*), which is the end surface of the inner end of the vanes (12), the vanes (12) are pressed radially outwards inside the vane grooves (11*a*), and the outer ends of the vanes (12) are pressed against the cam surface (17).

Consequently, the outer circumference front ends of the vanes (12) are pressed strongly by the cam ring (10), and therefore oil leaks are decreased, and consequently the discharge performance is improved. Via openings (63*a*, 63*b*), the first back pressure supply channel (62) communicates with a high-pressure chamber 70 via second back pressure supply channels (71, 72) and the back pressure chamber 11*d*, and furthermore a back pressure operating liquid is supplied to the back pressure chamber (11*d*) which corresponds to a vane (12) in a transition range from the discharge range to the

[Patent Document 1] Japanese Patent Application Publication No. 2005-120894

SUMMARY OF THE INVENTION

The first back pressure supply channel (62) communicates with both the angle range of the main pump and the angle range of the subsidiary pump, and therefore even when the subsidiary pump is in a circulating flow state, a back pressure due to the oil is applied continuously to the inner circumference side of the vanes (12) on the subsidiary pump side. Therefore, the outer circumference tips of the vanes (12) are pressed strongly against the cam ring (10), and hence the drive torque increases and consequently there is a risk of decline in efficiency.

Due to the foregoing, even if the subsidiary pump is caused to circulate in order to raise the efficiency, since the vanes 12 are pressed strongly against the cam ring (10), then the drive torque increases and there are limits on the improvement in efficiency. Therefore, an object of the present invention (the problem to be solved by the invention) is to decrease the contact pressure between the vanes of the subsidiary pump and the inner circumferential wall of the cam ring when at high pressure, thereby improving the pump efficiency at high pressure.

As a result of thorough research aimed at resolving the abovementioned problem, the present inventors resolved the abovementioned problem by configuring a first embodiment of the present invention as a vane pump provided with a pump unit comprising: a rotor in which a plurality of vanes are slidably mounted in a radial direction; a cam ring inside which the rotor is installed; a first side member having first main and subsidiary intake ports and first main and subsidiary discharge ports along a circumferential direction on both sides in the axial direction of the cam ring; and a second side member having second main and subsidiary intake ports and second main and subsidiary discharge ports along the circumferential direction, wherein a first main back pressure supply port and a first subsidiary back pressure supply port are formed in a first sliding contact surface of the first side member, the first main back pressure supply port is formed in a groove shape in the first sliding contact surface, the first subsidiary back pressure supply port is configured so as to communicate with the first subsidiary discharge port, a second main back pressure supply port and a second subsidiary back pressure supply port are formed in the second side member, the second main back pressure supply port passes through the second side member in the axial direction, and the second subsidiary back pressure supply port is formed in a groove shape in a second sliding contact surface without passing through the second side member in the axial direction.

The present inventors also resolved the abovementioned problem by configuring a second embodiment of the present invention as the vane pump according to the first embodiment, wherein the first subsidiary back pressure supply port has a groove shape, a small through hole is formed along the axial direction in a portion of the groove shape, and the small through hole communicates with the first subsidiary discharge port via an expulsion groove which is formed in a surface on the opposite side to the first sliding contact surface. The present inventors also resolved the abovementioned problem by configuring a third embodiment of the present invention as the vane pump according to the first embodiment, wherein the first subsidiary back pressure supply port passes through the first side member in the axial direction thereof, as well as communicating with the first subsidiary discharge port via an expulsion groove which is formed in a surface on the opposite side to the first sliding contact surface.

The present inventors also resolved the abovementioned problem by configuring a fourth embodiment of the present invention as the vane pump according to the first embodiment, wherein the first subsidiary back pressure supply port has a groove shape, and an expulsion hole flow channel which communicates between a portion of the groove shape and an intermediate location of the first subsidiary discharge port in the axial direction is formed. The present inventors also resolved the abovementioned problem by configuring a fifth embodiment of the present invention as the vane pump according to the first or second embodiments, wherein, when sending oil to equipment from the first subsidiary discharge port, oil pressure supplied to the first subsidiary back pressure supply port from the first subsidiary discharge port is high, and the oil pressure is low during circulation.

The present inventors also resolved the abovementioned problem by configuring a sixth embodiment of the present invention as the vane pump according to the first or second embodiments, wherein a back pressure chamber of the rotor 3 is configured so as to communicate with either the first subsidiary back pressure supply port or the first main back pressure supply port. The present inventors also resolved the abovementioned problem by configuring a seventh embodiment of the present invention as the vane pump according to the first or second embodiment, wherein the first subsidiary back pressure supply port is formed through a range from the vicinity of a virtual line linking a start end of the first subsidiary intake port with a center of diameter of the first side member to the vicinity of a virtual line linking a finish end of the first subsidiary discharge port with the center of diameter of the first side member along a direction of rotation of the rotor.

According to the present invention, at or above a prescribed speed of rotation, the discharged oil on the main discharge channel side and the subsidiary discharge channel side does not merge due to the flow channel switching valve which is provided in the vane pump, and the oil performs a circulating flow in the subsidiary discharge channel. Therefore, a portion of the oil discharge from the first subsidiary discharge port flows into the back pressure chambers via the first subsidiary back pressure supply port, but most of the oil is sent out simultaneously from the first subsidiary discharge port to the subsidiary discharge circulation flow channel.

Therefore, the oil flowing into the back pressure chambers from the first subsidiary back pressure supply port is extremely small and has virtually no pressure, and oil is simply present in the back pressure chambers. Even if this oil has pressure, the pressure is very small indeed. Consequently, no force (also called pressing force) to press the vanes in the outward radial direction of the rotor acts, and only a force due to centrifugal force acts on the vanes, thereby weakening the force with which the tips of the vanes press against the inner circumference side surface of the cam ring. Consequently, the drive torque of the pump can be reduced, the efficiency can be improved, and fuel consumption can be improved.

BRIEF DESCRIPTION OF THE DRAWINGS

FIG. 1A is a vertical cross-sectional side diagram of an invention provided with a first embodiment of a communicating structure between a first subsidiary back pressure supply port and a first subsidiary discharge port, and FIG. 1B is a cross-sectional view along arrow Y1-Y1 in FIG. 1A, FIG. 1C is a cross-sectional view along arrow Y2-Y2 in FIG. 1A, and FIG. 1D is a cross-sectional view along arrow Y3-Y3 in FIG. 1A;

FIG. 9A is an enlarged diagram showing a partial section of the first side member and the rotor in a further embodiment of the formation range of the first main back pressure supply port and the first subsidiary back pressure supply port according to the present invention, FIG. 9B is a diagram viewed from the first outer surface side of the first side member according to the further embodiment, and FIG. 9C is a diagram viewed from the first sliding contact surface of the first side member according to the further embodiment.

EMBODIMENTS OF THE INVENTION

Figure 2:
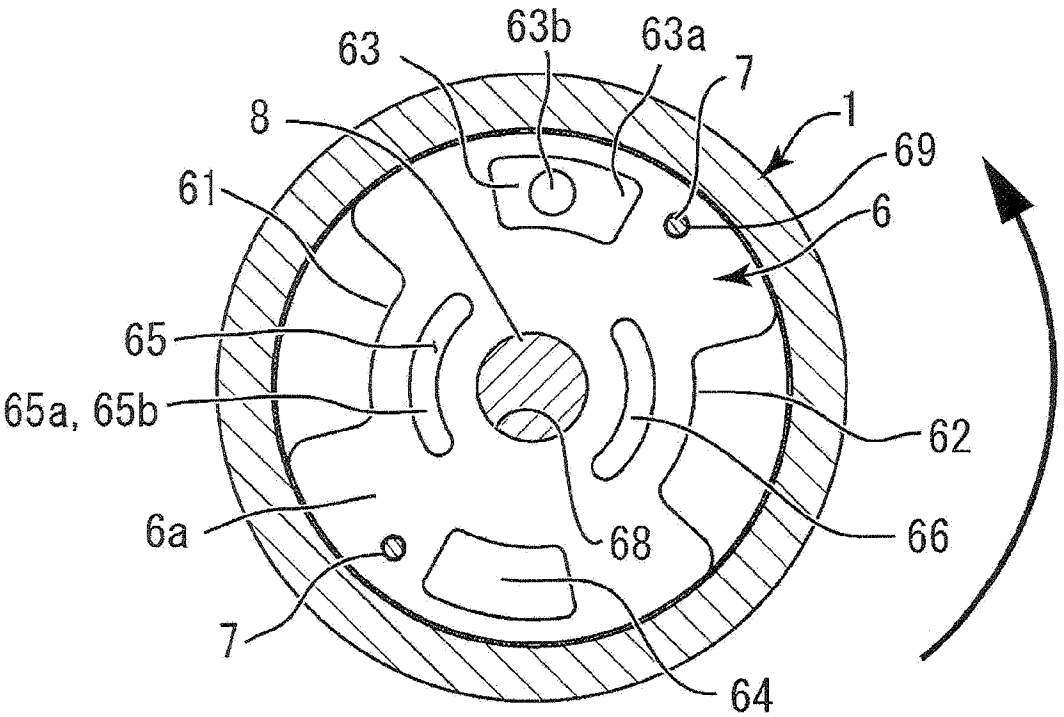
FIG. 2 is a cross-sectional diagram along arrow Y4-Y4 in FIG. 1A.

Below, the embodiments of the present invention are described with reference to the drawings. The vane pump according to the present invention is used as a hydraulic pump, or the like, for supplying a stepless transmission device (see FIG. 8). The present invention is principally configured by a pump unit A and a pump housing 1. The pump housing 1 is configured by a body half member 11 and a body half member 12, and accommodates a pump unit A (see FIG. 1A).

The body half member 11 is a frame portion, and the body half member 12 is a cover portion, but the opposite may also apply. Furthermore, the body half member 11 and the body half member 12 may both be frame-shaped members. The body half member 11 and the body half member 12 are connected by fixtures, such as bolts and nuts, etc., and a sealing member such as a sealing plate, or the like, is sandwiched between the mating surfaces thereof, thereby constituting a pump housing 1 having a sealed structure. The pump housing 1 is provided internally with a flow channel switching valve 95, or the like, which is described above, and there are no particular restrictions on the shape thereof.

Axial holes 13*a*, 13*b* through which a drive axle for driving rotation of the rotor 3 of the pump unit A is passed are formed in the body half member 11 and the body half member 12. An intake channel 14 for sending fluid, such as oil, into the pump unit A (see FIG. 1A) is provided in the pump housing 1 (see FIG. 1A). The intake channel 14 is formed separately in the body half member 11 and the body half member 12 respectively.

Next, the pump unit A will be described. The pump unit A is configured by a cam ring 2, a rotor 3, vanes 4, a first side member 5 and a second side member 6, etc. (see FIG. 1). The cam ring 2 is formed in a ring shape, and has an inner circumference side surface 21 formed in a substantially elliptical shape. The axial direction cross-sectional shape of the inner circumference side surface 21 is an elliptical or substantially elliptical shape (see FIGS. 1A and 1B). The rotor 3 on which the vanes 4 are mounted is accommodated in the cam ring 2, and therefore the cam ring 2 may also be called a rotor housing or a rotor casing.

The inner circumference side surface 21 is substantially barrel-shaped and the corners thereof may be formed in an arc shape. The inner circumference side surface 21 is a portion which is contacted by the tips of the plurality of vanes 4 mounted on the rotor 3, and when the vanes 4 seek to project outwards due to the centrifugal force while the rotor 3 is rotating, the vanes 4 exit from and enter into the vane grooves 31 by following the shape of the inner circumference side surface 21 of the cam ring 2. Therefore, the inner circumference side surface 21 serves the role of a cam, and may be called the cam inner circumference side surface or the inner circumference cam surface. The rotor 3 is formed in a round cylindrical shape, and a plurality of vane grooves 31 are cut along the axial direction and in the direction of the center of diameter of the rotor are provided at even intervals apart in the circumferential direction. The vanes 4 are slidably inserted in the radial direction inside the vane grooves 31 of the rotor 3 (see FIG. 1B).

Back pressure chambers 32 are formed at the inner ends in the radial direction of the vane grooves 31. The back pressure chambers 32 and the vane grooves 31 communicate with each other. The cross-section of the back pressure chambers 32 perpendicular to the axial direction is a circular shape, and the inner diameter of the back pressure chambers 32 is formed to be greater than the width of the vane grooves 31. Furthermore, the back pressure chambers 32 also jointly use of end portions of the vane grooves 31 on the side near the center of diameter of the rotor 3. Oil is sent into the back pressure chambers 32, thereby applying pressure is applied to the inner end sides of the vanes 4, and the vanes 4 seek to press out in the outward radial direction of the rotor 3 from the vane grooves 31.

The rotor 3 configured in this way is accommodated inside the cam ring 2. A rotor axle hole 38 into which the drive axle 8 is inserted is formed at the center of rotation of the rotor 3, and the drive axle 8 is fixed by a fixing means, such as a key or spline, etc. The outer ends of the vanes 4 inserted into the vane grooves 31 of the rotor 3 contact the inner circumference side surface 21 at all times due to the pressure of the oil collected inside the back pressure chambers 32, as well as the centrifugal force due to the rotation of the rotor 3.

A first side member 5 is disposed in contact with one end portion of the cam ring 2 in the axial direction, and a second side member 6 is disposed in contact with the other end portion of the cam ring 2 in the axial direction, and both ends of each vane 4 in the axial direction respectively contact, in slidable fashion, with the first side member 5 and the second side member 6. The pump unit A which is constituted by the cam ring 2, the rotor 3, the vanes 4, the first side member 5 and the second side member 6 is accommodated in the pump housing 1 which is constituted by the body half member 11 and the body half member 12 (see FIG. 1).

Here, the cam ring 2, the rotor 3, the vanes 4, and the first side member 5 and second side member 6 are fixed in the circumferential direction by two fixing axles 7, thereby constituting the pump unit A. A fixing axle hole 39 is formed in the cam ring 2, a fixing axle hole 59 is formed in the first side member 5, and a fixing axle hole 69 is formed in the second side member 6. The first side member 5 and the second side member 6 are disposed on either side of the rotor 3 in the axial direction, the fixing axles 7 are inserted through the fixing axle holes 59, 39, 60, and the integrated pump unit A constituted thereby is accommodated in the pump housing 1 (see FIGS. 1B, 1C, 1D and FIG. 2). The rotor 3 rotates due to the rotation of the drive axle 8 which is mounted in the pump housing 1.

The cam ring 2, the first side member 5 and the second side member 6 are configured so as to be fixed in the axial direction and the circumferential direction by the fixing axles 7, but are not necessarily limited to being fixed by the fixing axles 7 and a configuration may also be adopted in which projections and recesses with which the cam ring 2 and the first side member 5 of the cam ring 2 and the second side member 6 respectively interlock and mutually engage are formed, and by interlocking or engaging these, the cam ring 2, the first side member 5 and the second side member 6 are joined and fixed. The volume of the spaces (or chambers) partitioned by the inner circumference side surface 21 of the cam ring 2 and the plurality of vanes 4 mounted about the periphery of the rotor 3 repeatedly expands and contacts with the rotation of the rotor 3, thereby performing intake and discharge.

The intake channel 14 formed in the pump housing 1 communicates with a first main intake port 52 and a first subsidiary intake port 51 which are formed in the first side member 5 described below, and a second main intake port 62 and a second subsidiary intake port 61 which are formed in the second side member 6 described below, whereby fluid can be sent into the pump unit A.

The vane pump of the present invention is provided with a main pump constituted by the first main intake port 52 and the first main discharge port 53, and a subsidiary pump constituted by the first subsidiary intake port 51 and the first subsidiary discharge port 54. Therefore, on the main pump side, oil is sent at all times to equipment 96, which is a transmission or engine, etc., but the subsidiary pump may be in a state of sending oil to the equipment 96, such as a transmission or engine, etc. or a state of circulating the oil in the subsidiary discharge circulation flow channel 93, without the oil flowing to the equipment 96.

Furthermore, a main discharge channel 15 and a subsidiary discharge channel 16 are formed in the pump housing 1 which is constituted by the body half member 11 and the body half member 12. The main discharge channel 15 communicates with a first main discharge port 53 which is formed in the first side member 5 described below, and a second main discharge port 63 which is formed in the second side member 6, whereby fluid can be discharged.

Furthermore, the subsidiary discharge channel 16 communicates with the first subsidiary discharge port 54 formed in the first side member 5 and the second subsidiary discharge port 64 formed in the second side member 6, and hence fluid can be discharged. The first side member 5 includes the first main intake port 52, the first subsidiary intake port 51, the first main discharge port 53 and the first subsidiary discharge port 54 (see FIGS. 1B, 1C and FIGS. 3A to 3D). The first main intake port 52 and the first subsidiary intake port 51 of the first side member 5 have a circular disc shape in which a circular arc shaped portion is cutaway on both sides of the radial direction.

Moreover, the first main discharge port 53 and the first subsidiary discharge port 54 are formed as through holes in the axial direction. Furthermore, the first side member 5 has a first sliding contact surface 5*a* on the side which contacts the cam ring 2, the rotor 3 and the vanes 4, and has a first outer surface 5*b* on the opposite side thereto. In a state where the first side member 5 is joined to the cam ring 2, the first main intake port 52, the first main discharge port 53, the first subsidiary intake port 51 and the first subsidiary discharge port 54 are arranged at even intervals apart in this order along the direction of rotation of the rotor 3.

An axle hole 58 is formed in the center of the first side member 5 in the radial direction, and a first main back pressure supply port 55 and a first subsidiary back pressure supply port 56 are formed in the first sliding contact surface 5*a* and about the periphery of the axle hole 58. Furthermore, the central point of the axle hole 58 is called the center of diameter P1. The center of diameter P1 is the center of the first side member 5. Therefore, the center of diameter P1 is called the center of diameter of the first side member 5. The first main back pressure supply port 55 and the first subsidiary back pressure supply port 56 are formed at positions having point symmetry with respect to the center of diameter of the axle hole 58, and are arranged so as to encompass the plurality of back pressure chambers 32. (see FIGS. 3A and 3B). Therefore, the first main back pressure supply port 55 and the first subsidiary back pressure supply port 56 are formed as arc-shaped grooves of which the substantial center of diameter is the axle hole 58.

The first main back pressure supply port 55 is formed in a groove shape in the first sliding contact surface 5*a* without passing through the first sliding contact surface 5*a* in the axial direction. Furthermore, the first subsidiary back pressure supply port 56 communicates with the first subsidiary discharge port 54. Moreover, specifically, the first subsidiary back pressure supply port 56 is configured so as to communicate with the first subsidiary discharge port 54 on the surface opposite to the side of the first sliding contact surface 5*a*. There exist a plurality of embodiments for the communication structure between the first subsidiary back pressure supply port 56 and the first subsidiary discharge port 54.

In the first embodiment, as shown in FIGS. 3A to 3D, the first subsidiary back pressure supply port 56 is groove shaped on the first sliding contact surface 5*a*, a small through hole 56*a* is formed along the axial direction in a portion of this groove shape, and one end of this small through hole 56*a* communicates with an expulsion groove 571 that communicates with the first subsidiary discharge port 54.

Figure 7B:
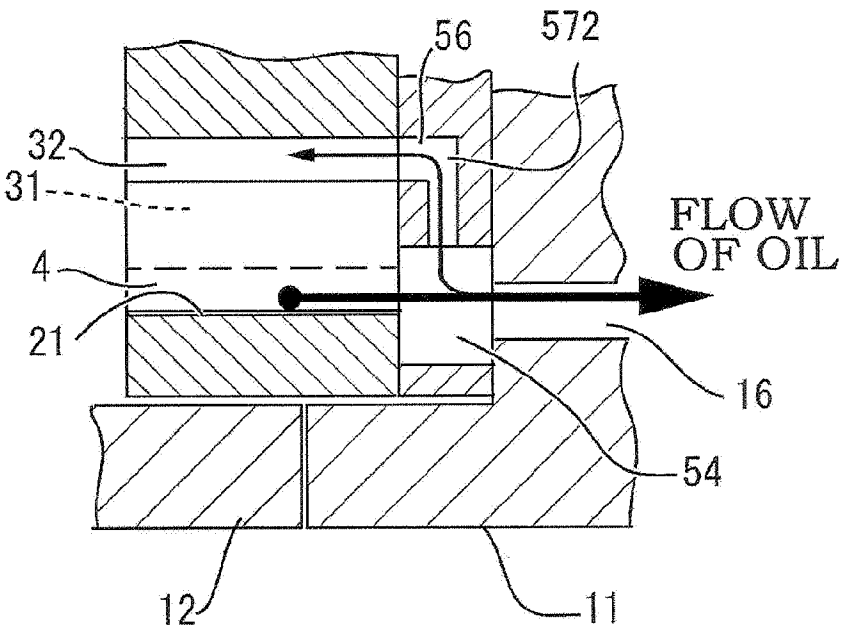
FIG. 7B is a is a principal enlarged diagram of the present invention provided with a third embodiment of a communicating structure between the first subsidiary back pressure supply port and the first subsidiary discharge port.
Figure 7A:
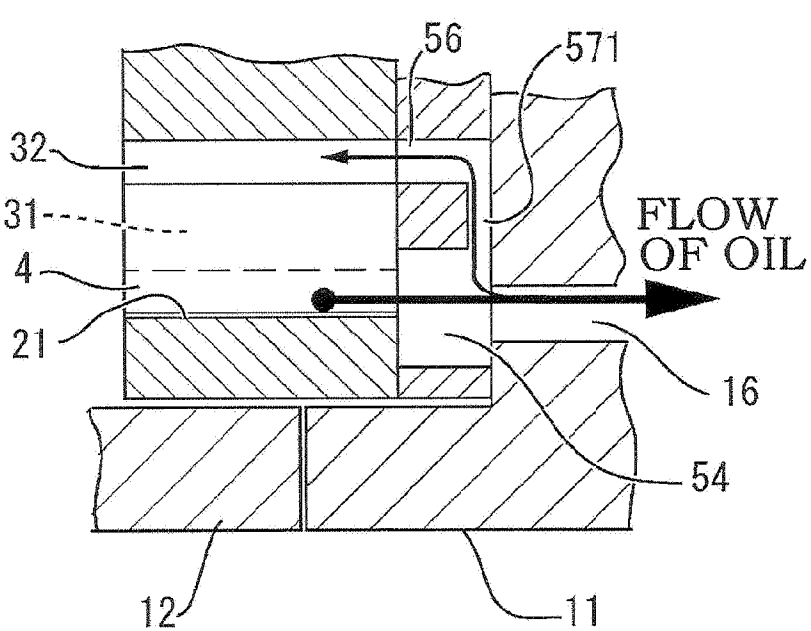
FIG. 7A is a principal enlarged diagram of the present invention provided with a second embodiment of a communicating structure between the first subsidiary back pressure supply port and the first subsidiary discharge port.

In the second embodiment, as shown in FIG. 7A, the first subsidiary back pressure supply port 56 passes through the whole region of the first side member 5 in the axial direction, in other words, from the first sliding contact surface 5*a* to the first outer surface 5*b*. An expulsion groove 571 is formed between the opening portion of the first subsidiary back pressure supply port 56 on the side of the first outer surface 5*b*, and the first subsidiary discharge port 54, and the first subsidiary back pressure supply port 56 communicates with the first subsidiary discharge port 54 via the expulsion groove 571.

In the third embodiment, as shown in FIG. 7B, the first subsidiary back pressure supply port 56 is formed in a groove shape in the first sliding contact surface 5*a*, and an expulsion hole flow channel 572 which communicates a portion of the region of the first subsidiary back pressure supply port 56 with an intermediate portion of the first subsidiary discharge port 54 in the axial direction is formed. The expulsion hole flow channel 572 is formed as a substantially tunnel-shaped channel hole inside the material of the first side member 5.

Next, the second side member 6 has the second main intake port 62, the second subsidiary intake port 61, the second main discharge port 63 and the second subsidiary discharge port 64 (see FIG. 2 and FIGS. 3E to 3G). The second main intake port 62 of the second side member 6 and the second subsidiary intake port 61 are formed in a stepped shaped on both sides of the radial direction of a circular disk. Furthermore, the second main intake port 62 and the second subsidiary intake port 61 of the second side member 6 are configured to pass therethrough, similarly to the first main intake port 52 and the first subsidiary intake port 51 of the first side member 5.

In this case, the shape of the second side member 6 is a substantially similar shape to the first side member 5, namely, a shape in which both sides in the radial direction of a circular disk are cut away. The second main discharge port 63 is configured so as to pass through the second side member 6 in the axial direction. More specifically, the second main discharge port 63 has a sunken recess section 63*a* on the side of the second sliding contact surface 6*a* of the second side member 6, and a through hole 63*b* is formed to pass through in the axial direction between one portion of the bottom surface of the recess section 63*a* and a second outer surface 6*b* of the second side member 6 (see FIGS. 3E, 3F and FIG. 6, etc.) Furthermore, the second main discharge port 63 may be configured so as to pass through the second side member 6 in the axial direction, while preserving the opening shape of the recess section 63*a*.

Furthermore, the first main discharge port 53 and the first subsidiary discharge port 54 are formed as through holes in the axial direction. Moreover, in the second side member 6, the side which contacts the cam ring 2, the rotor 3 and the vanes 4 is the second sliding contact surface 6*a*, and the opposite side thereto is the second outer surface 6*b*. When the second side member 6 is joined to the cam ring 2, the second main intake port 62, the second main discharge port 63, the second subsidiary intake port 61 and the second subsidiary discharge port 64 are arranged at even intervals apart in this order, in the direction of rotation of the rotor 3. An axle hole 68 is formed in the center of the second side member 6 in the radial direction thereof, and a second main back pressure supply port 65 and a second subsidiary back pressure supply port 66 are formed in the second sliding contact surface 6*a* about the circumference of the center of diameter of the axle hole 68.

The second main back pressure supply port 65 and the second subsidiary back pressure supply port 66 are formed at positions having point symmetry with respect to the center of diameter of the axle hole 68 and are arranged so as to surround the plurality of back pressure chambers 32. The second main back pressure supply port 65 passes through in the axial direction, in other words, from the second sliding contact surface 6*a* to the second outer surface 6*b*.

Figures 3A, 3B, 3C, 3D, 3E, 3F, 3G:
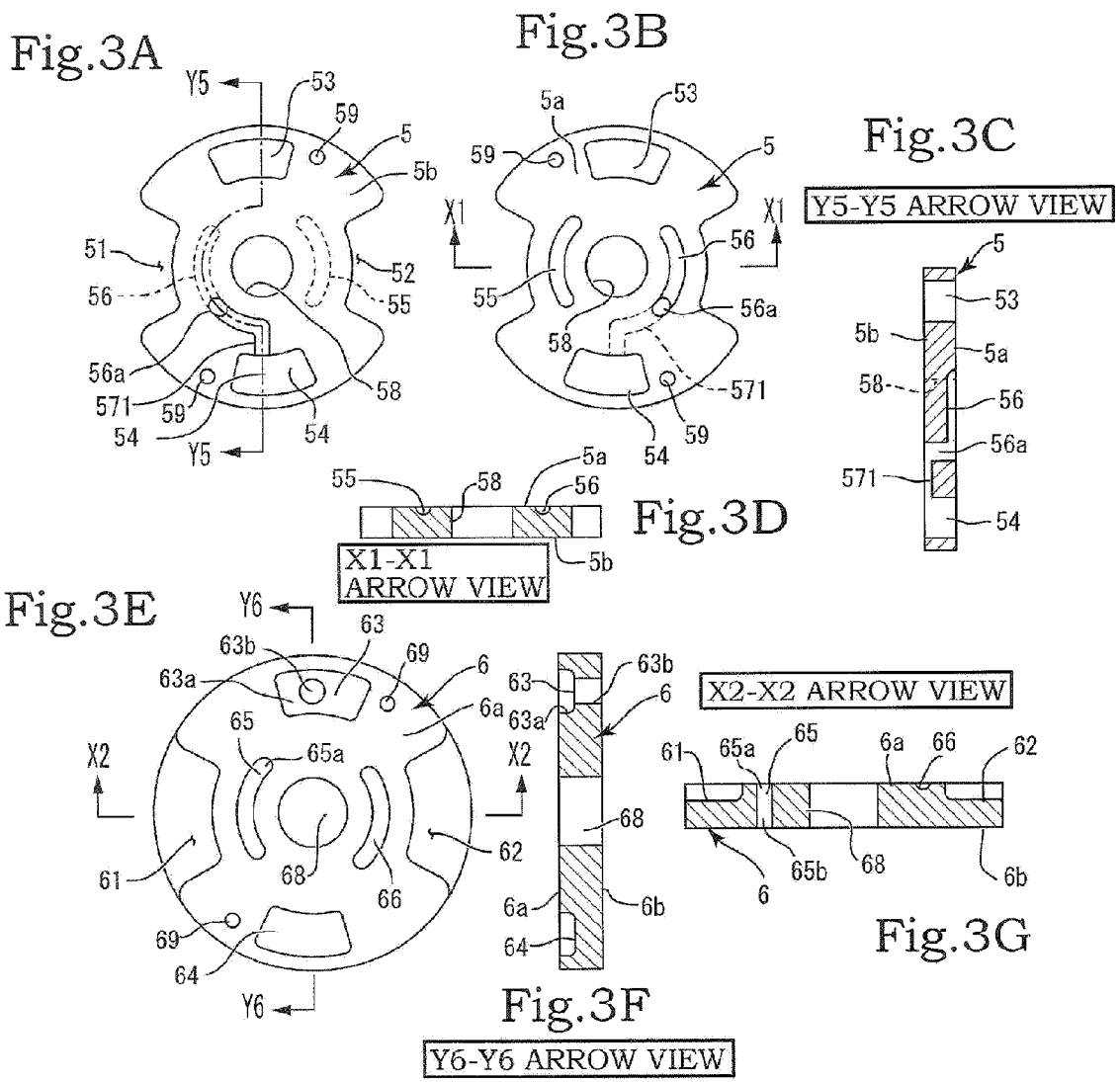
FIG. 3A is a diagram showing a first outer surface of a first side ember.
FIG. 3B is a view from a first sliding contact surface of the first side member.
FIG. 3C is a cross-sectional diagram along arrow Y5-Y5 of FIG. 3A.
FIG. 3D is a cross-sectional diagram along arrow X1-X1 of FIG. 3B.
FIG. 3E is a diagram viewed from a second sliding contact surface of a second side member.
FIG. 3F is a cross-sectional diagram along arrow Y6-Y6 in FIG. 3E.
FIG. 3G is a cross-sectional diagram along arrow X2-X2 in FIG. 3E.
Figure 4:
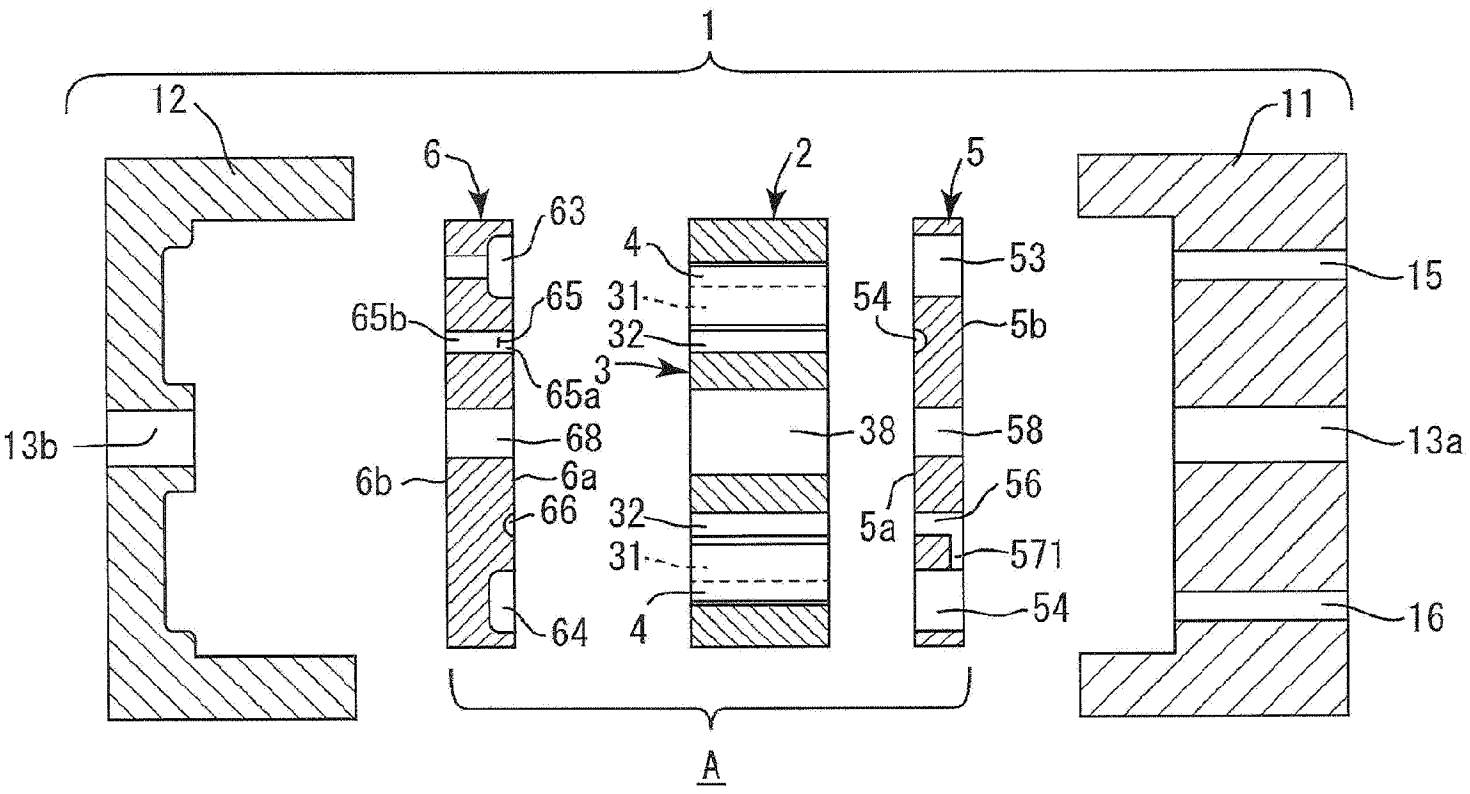
FIG. 4 is an exploded longitudinal cross-sectional view of the main members constituting the present invention.

More specifically, the second main back pressure supply port 65 comprises a groove section 65*a* and a through section 65*b*, and due to the through section 65*b*, the second main back pressure supply port 65 passes through the second side member 6 in the axial direction (see FIG. 3G). The groove section 65*a* and the through section 65*b* are formed in a substantially integrated fashion, and it is possible to adopt a configuration in which the second main back pressure supply port 65 is formed as a groove-shaped through hole or a configuration in which the through section 65*b* is formed as a through hole formed in a portion of the groove section 65*a*. The second subsidiary back pressure supply port 66 is formed in a groove shape in the second sliding contact surface 6*a* without passing through the second sliding contact surface 6*a* in the axial direction.

The flow channel switching valve 95 is provided together with the pump unit A in the pump housing 1. The flow channel switching valve 95 serves to switch between a subsidiary circulation discharge flow channel 92 on the subsidiary discharge channel 16 side of the vane pump of the present invention and a subsidiary discharge circulation flow channel 93. More specifically, this valve is a circulation circuit which sends oil to the equipment 96 such as a transmission or engine, and serves to switch between a subsidiary circulation discharge flow channel 92 which merges with the main circulation discharge flow channel 91 on the side of the main discharge channel 15 and a subsidiary discharge circulation flow channel 93 in which oil is circulated between the subsidiary discharge channel 16 and the intake channel 14 side (see FIG. 8).

In other words, the discharge oil on the side of the subsidiary discharge channel 16 can be switched by the flow channel switching valve 95, so as to either merge with the main circulation discharge flow channel 91 and flow into the transmission or the engine, or so as to return to the intake channel 14 side and perform a circulating operation. The flow channel switching valve 95 uses a type of valve which is driven by hydraulic pressure or a solenoid valve, etc. As stated above, the flow channel switching valve 95 may also be provided outside the pump housing 1, instead of being provided inside the pump housing 1.

Next, the operation will be described with reference to FIG. 5, FIG. 6 and FIG. 8, etc. taking the example of a case where the vane pump of the present invention is provided in a circulation circuit which sends oil to equipment 96 such as a transmission or an engine. Firstly, in the vane pump according to the present invention, when at or below a prescribed speed of rotation (for example, low speed), the oil taken in from the intake channel 14 is discharge from the main discharge channel 15 and the subsidiary discharge channel 16, and the oil flowing in both channels merges and is supplied to a circulation circuit, or the like, of the equipment 96, such as the transmission or engine. Furthermore, when the pump is operating, oil enters into the back pressure chambers 32 which communicate with the first subsidiary back pressure supply port 56 and the second subsidiary back pressure supply port 66. The pressure in the oil discharge from the first subsidiary discharge port 54 is propagated to the oil inside the back pressure chambers 32.

In the circulation circuit of the equipment 96, such as the transmission or engine, the main discharge channel 15 flows into the main circulation discharge flow channel 91, and the subsidiary discharge channel 16 flows into the subsidiary circulation discharge flow channel 92. Furthermore, oil returns from the equipment 96 such as the mission or engine, to the vane pump, via the return flow channel 94 (see FIG. 8A). This main discharge channel 15 flows into the main circulation discharge flow channel 91, and in a state where the subsidiary discharge channel 16 is flowing into the subsidiary circulation discharge flow channel 92, the discharge pressure from the first subsidiary discharge port 54 increases, and the large pressure thereof is propagated to the back pressure chambers 32 which communicate with the first subsidiary back pressure supply port 56 and the first subsidiary back pressure supply port 56, the pressing force acting on the vanes 4 in the vane grooves 31 from the back pressure chambers 32 increases, the pressure with which the tips of the vanes 4 contact the inner circumference side surface 21 of the cam ring 2 rises, and a waste-free pumping operation is performed.

Figure 8A:
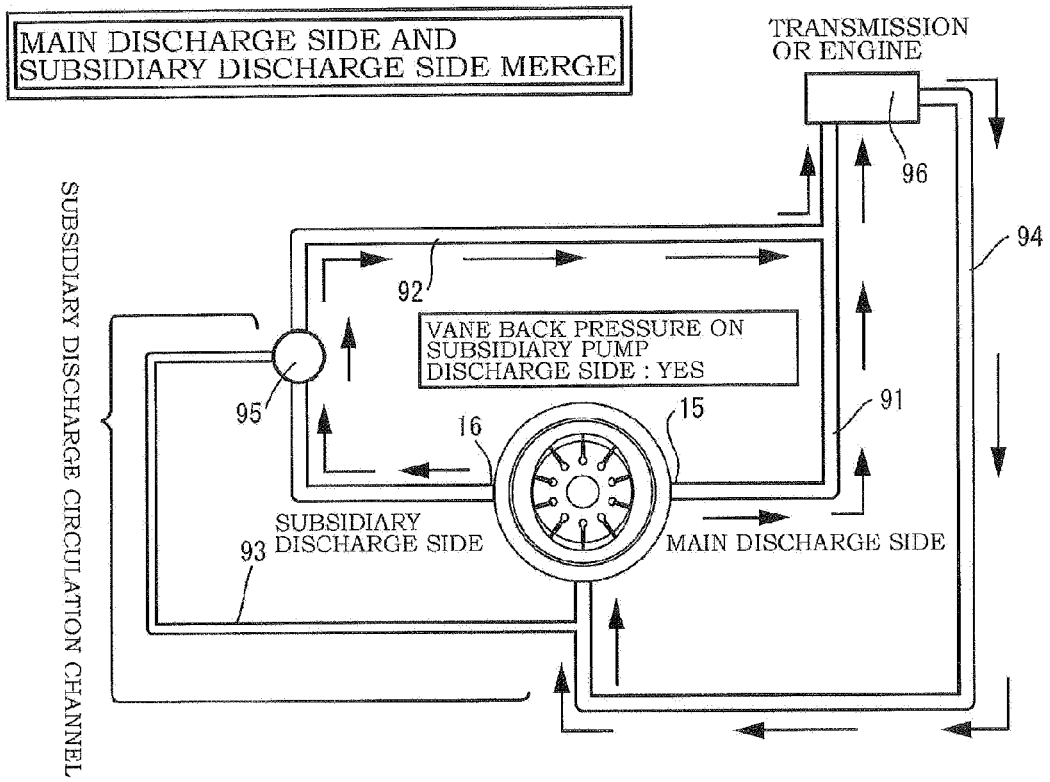
FIG. 8A is an illustrative diagram showing a flow in which oil on the main discharge side and the subsidiary discharge side merges in a circulation circuit of a transmission or an engine according to the present invention.
Figure 8B:
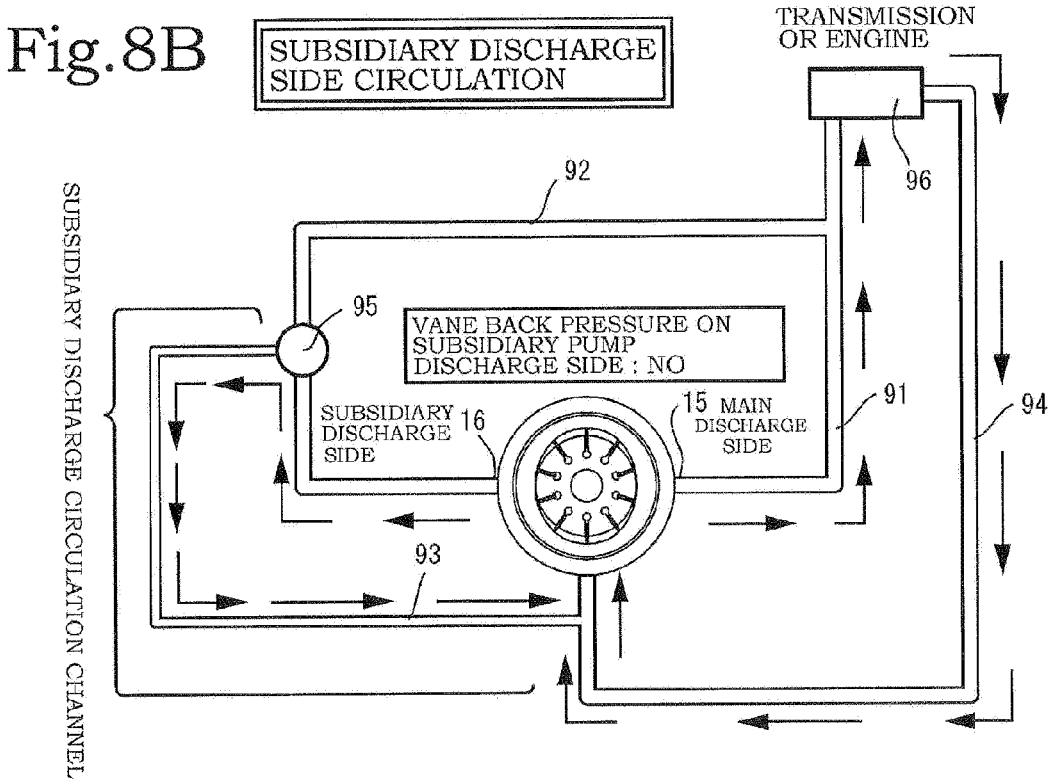
FIG. 8B is an illustrative diagram showing a flow of oil circulating on the subsidiary discharge side.

Next, when the vane pump is operating at or above a prescribed speed of rotation (for example, a medium or high speed), then the oil which is taken in from the intake channel 14 is discharged from the main discharge channel 15 and the subsidiary discharge channel 16, but due to the flow channel switching valve 95 provided on the subsidiary discharge channel 16 side, the flow channel is switched and oil flows from the subsidiary discharge channel 16 into the subsidiary discharge circulation flow channel 93, whereby the oil assumes a circulating state on the subsidiary discharge side (see FIG. 8B).

The first subsidiary back pressure supply port 56 of the first side member 5 is structured so as to communicate with the first subsidiary discharge port 54, and has an oil pressure substantially equal to that of the first subsidiary discharge port 54 via the expulsion groove 571, etc. (see FIG. 5 and FIG. 6). Therefore, on the subsidiary discharge side, in the case of FIG. 8B where the oil is in a circulating state, the discharge pressure from the first subsidiary discharge port 54 is smaller, and the propagation of pressure to the oil inside the back pressure chambers 32 which communicate with the first subsidiary back pressure supply port 56 and the first subsidiary back pressure supply port 56 becomes smaller. Therefore, since the oil pressure at the first subsidiary discharge port 54 becomes smaller, then in a coordinated fashion, the oil pressure at the first subsidiary back pressure supply port 56 of the first side member 5 is also small, and the force pressing on the vanes 4 inside the vane grooves 31 from the back pressure chambers 32 becomes weak, increase in wasteful resistance is prevented and decline in the pump efficiency is prevented.

Due to the abovementioned configuration, if the subsidiary discharge side does not discharge oil to the equipment 96, such as a transmission or engine, in other words, if the subsidiary discharge side is not performing a task of discharging oil, then since the oil pressure of the first subsidiary back pressure supply port 56 is reduced and the oil pressure of the back pressure chambers 32 corresponding to the first subsidiary back pressure supply port 56 is reduced, then the force which presses the vanes 4 against the inner circumference side surface 21 of the cam ring 2 on the subsidiary discharge side which corresponds to the phase of the first subsidiary back pressure supply port 56 is weakened. Consequently, it is possible to improve the pump efficiency since the drive torque of the vane pump can be reduced, and therefore the fuel efficiency can also be improved.

The main discharge side and the subsidiary discharge side which are in the state shown in FIG. 8A merge and when the oil on the subsidiary discharge side flows to the equipment such as the transmission or engine, a high oil pressure is applied to the first subsidiary discharge port 54, and in coordination with this, the oil pressure of the back pressure chambers 32 corresponding to the first subsidiary back pressure supply port 56 also becomes higher, and consequently, a beneficial effect is also obtained in that the discharge pressure on the subsidiary discharge side can also be kept high.

The range of formation of the first main back pressure supply port 55 and the first subsidiary back pressure supply port 56 in the first side member 5 is described next. There exist multiple embodiments for the formation range of the first main back pressure supply port 55 and the first subsidiary back pressure supply port 56. Firstly, in a first embodiment of the formation range of the first main back pressure supply port 55 and the first subsidiary back pressure supply port 56, as shown in FIG. 5, the first main back pressure supply port 55 is formed near the center of diameter P1 of the first side member 5 so as to cover a range from the vicinity of a virtual line La which links the start end 52*a* of the first main intake port 52 with the center of diameter P1 of the first side member 5, to the vicinity of a virtual line Lb which links the finish end 52*b* of the first main intake port 52 with the center of diameter P1, and at a position where the back pressure chambers 32 of the rotor 3 are encompassed thereby.

Figure 5:
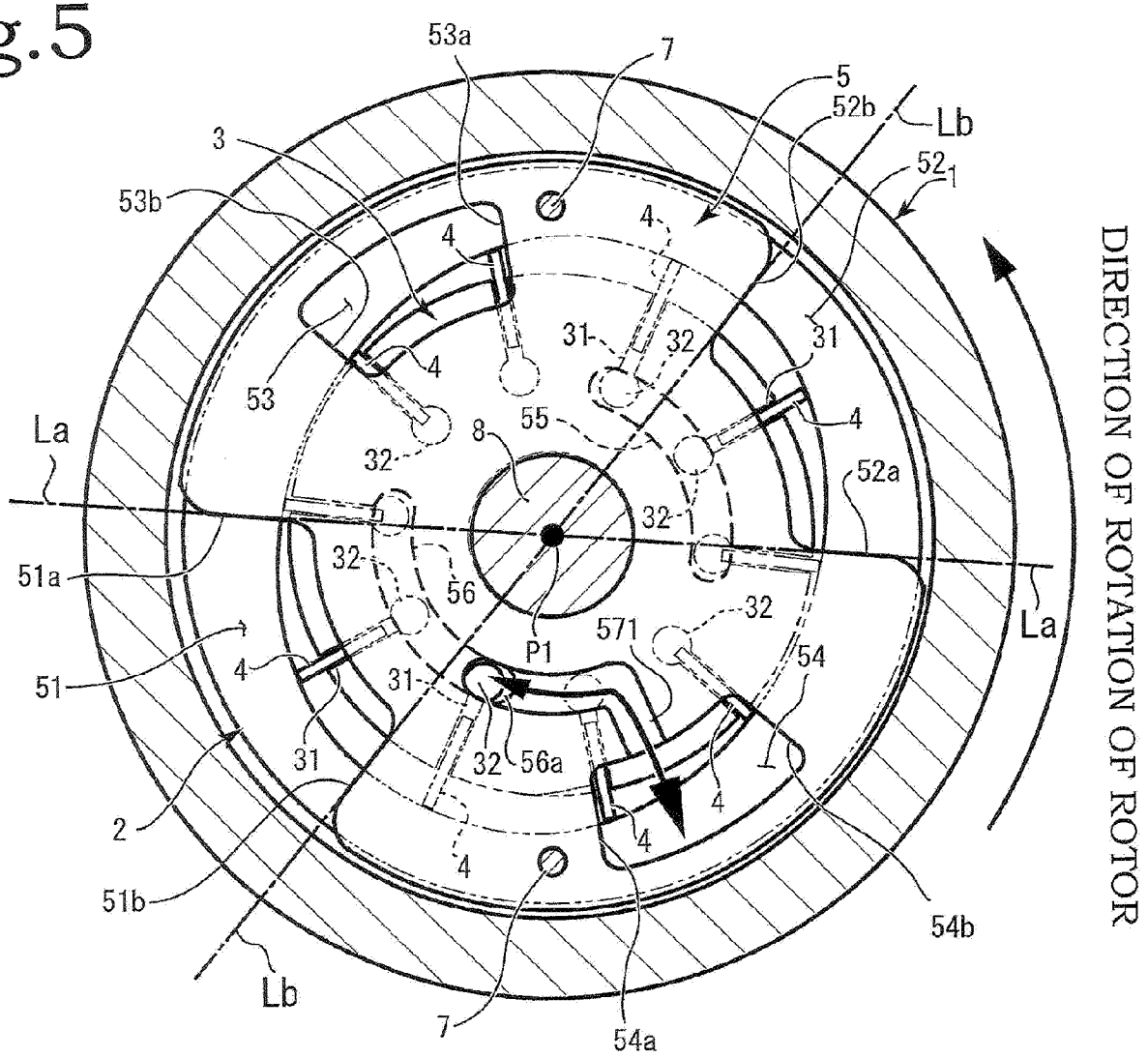
FIG. 5 is an enlarged diagram showing a partial sectional view of back pressure chambers of a rotor, a first subsidiary back pressure supply of the first side member and the state of flow of oil from a first subsidiary discharge port according to the present invention.

Here, the start ends 52*a*, 53*a*, 51*a*, 54*a* and the finish ends 52*b*, 53*b*, 51*b*, 54*b* of the first main intake port 52, the first main discharge port 53, the first subsidiary intake port 51 and the first subsidiary discharge port 54 are located at positions which are set in accordance with the direction of rotation of the rotor 3, and the forward side in the direction of rotation is taken as the start end, and the rear side in the direction of rotation is taken as the rear end (see FIG. 5 and FIG. 9A).

The first main back pressure supply port 55 and the first main intake port 52 are not located in the same position in the diameter direction of the first side member 5 and do not mutually intersect. Furthermore, the first main back pressure supply port 55 is positioned nearer to the center of diameter P1 than the inner circumference side surface of the first main intake port 52, in the diameter direction of the first side member 5. Here, the center of diameter P1 of the first side member 5 is the center of diameter of the axle hole 58 of the first side member 5.

The first subsidiary back pressure supply port 56 is formed near the center of diameter P1 of the first side member 5 so as to cover a range from the vicinity of the virtual line La which links the start end 51*a* of the first subsidiary intake port 51 with the center of diameter P1, to the vicinity of the virtual line Lb which links the finish end 51*b* of the first subsidiary intake port 51 with the center of diameter P1, and at a position where the back pressure chambers 32 of the rotor 3 are encompassed by and communicate with the first subsidiary back pressure supply port 56. The first subsidiary back pressure supply port 56 and the first subsidiary intake port 51 are not located in the same position in the diameter direction of the first side member 5 and do not mutually intersect.

Furthermore, the first subsidiary back pressure supply port 56 is positioned nearer to the center of diameter P1 than the surface on the inner circumference side of the first subsidiary intake port 51, in the diameter direction of the first side member 5. In the formation range of the first main back pressure supply port 55 and the first subsidiary back pressure supply port 56 according to the first embodiment, there are cases where none of the back pressure chambers 32 of the rotor 3 intersect with either the first main back pressure supply port 55 or the first subsidiary back pressure supply port 56 during rotation (see FIG. 5).

In other words, during rotation of the rotor 3, when the back pressure chambers 32 pass the first main back pressure supply port 55 and the first subsidiary back pressure supply port 56, the back pressure chambers 32 are encompassed by and communicate with the first main back pressure supply port 55 and the first subsidiary back pressure supply port 56, the pressure of the oil is propagated, and the vanes 4 in the vane grooves 31 are pressed by the back pressure chambers 32. In the embodiment of the present invention, the number of back pressure chambers 32 in the rotor 3 is ten, and three of the back pressure chambers 32 are respectively encompassed by and communicate with the first main back pressure supply port 55 and first subsidiary back pressure supply port 56.

Next, a second embodiment of the range of formation of the first main back pressure supply port 55 and the first subsidiary back pressure supply port 56 are described (see FIG. 9). In this embodiment, all of the back pressure chambers 32 of the rotor 3 are encompassed by and communicate with either one of the first main back pressure supply port 55 or the first subsidiary back pressure supply port 56 (see FIG. 9A). In other words, the back pressure chambers 32 of the rotor 3 during rotation are encompassed by and communicate with either one of the first main back pressure supply port 55 and the first subsidiary back pressure supply port 56.

More specifically, the first main back pressure supply port 55 is formed near the center of diameter of the first side member 5 so as to cover a range along the direction of rotation of the rotor 3 from the vicinity of the virtual line La which links the finish end 54*b* of the first subsidiary discharge port 54 with the center of diameter P1 of the first side member 5, to the vicinity of the virtual line Lb which links the start end 51*a* of the first subsidiary intake port 51 with the center of diameter P1, through an angle exceeding 180 degrees, and at a position where the back pressure chambers 32 of the rotor 3 are encompassed thereby. The first main back pressure supply port 55 is formed near the center of diameter of the first side member 5 so as to cover a range in the vicinity of the finish end 54*b* of the first subsidiary discharge port 54, and at a position where the back pressure chambers 32 of the rotor 3 are encompassed by and communicate with first main back pressure supply port 55.

The first main back pressure supply port 55 and the first main intake port 52 are not located in the same position in the diameter direction of the first side member 5 and do not mutually intersect. Furthermore, the first main back pressure supply port 55 is positioned nearer to the center of diameter P1 than the surface on the inner circumference side of the first main intake port 52, in the diameter direction of the first side member 5.

Furthermore, the first subsidiary back pressure supply port 56 is formed near the center of diameter of the first side member 5 so as to cover a range from the vicinity of the virtual line Lb which links the start end 51*a* of the first subsidiary intake port 51 with the center of diameter P1 of the first side member 5, to the vicinity of the virtual line La which links the finish end 54*b* of the first subsidiary discharge port 54 with the center of diameter P1, and at a position where the back pressure chambers 32 of the rotor 3 are encompassed thereby.

The first subsidiary back pressure supply port 56 is formed near the center of diameter P1 of the first side member 5 so as to cover a range in the vicinity of the finish end 54*b* of the first subsidiary discharge port 54, and at a position where the back pressure chambers 32 of the rotor 3 are encompassed by and communicate with the first subsidiary back pressure supply port 56. In the embodiment of the present invention, the number of back pressure chambers 32 of the rotor 3 is ten, and seven of the back pressure chambers 32 are encompassed by and communicate with the first main back pressure supply port 55, and three back pressure chambers 32 are encompassed by and communicate with the first subsidiary back pressure supply port 56.

Next, the relationship between the vanes and the pressure state in the back pressure chambers 32 in the circulating state on the subsidiary pump side (see FIG. 8B) will be described. All of the back pressure chambers 32 of the rotor 3 are encompassed by and communicate with either one of the first main back pressure supply port 55 and the first subsidiary back pressure supply port 56.

Figure 6:
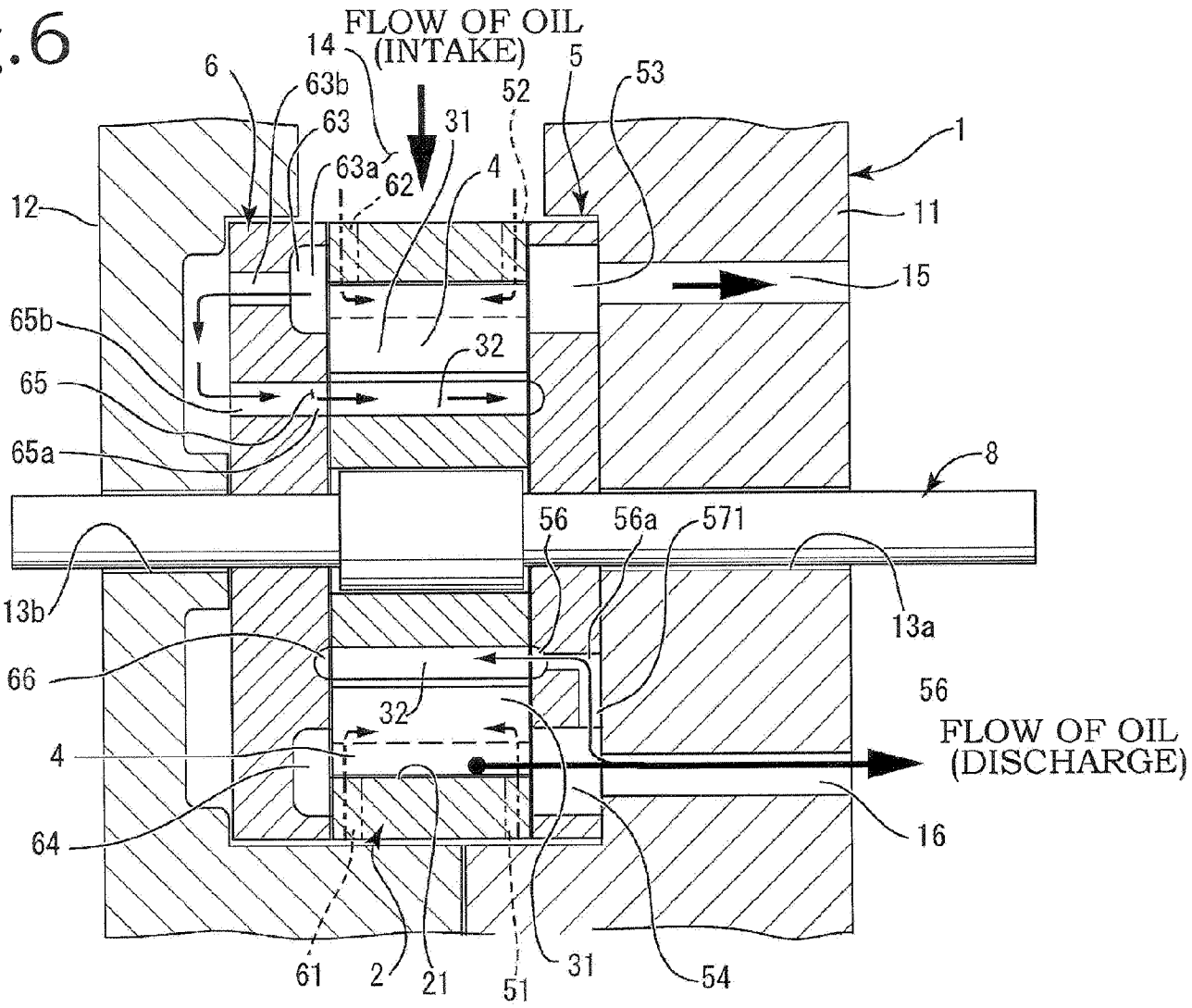
FIG. 6 is an enlarged longitudinal cross-sectional view showing back pressure chambers of the rotor, the first subsidiary back pressure supply of the first side member, and the state of flow of oil from the first subsidiary discharge port according to the present invention.

On the main pump side, when oil flows in to the second main discharge port 63, the oil flows in from the second main back pressure supply port 65 which passes through the second side member 6 in the axial direction, and seeks to flow into the back pressure chambers 32 (see FIG. 6). Since the back pressure chambers 32 are filled with oil at all times, then the oil in the second main back pressure supply port 65 propagates pressure to the oil inside the back pressure chambers 32.

Due to this propagation of the pressure, a pressure is applied which presses the vanes 4 out from the vane grooves 31, and the vanes 4 on the main pump side press against the inner circumference side surface 21 of the cam ring 2 with an appropriately large pressing force at all times, and the pump operates with good efficiency. Next, on the subsidiary pump side, when the oil is sent to the equipment 96, such as the transmission or engine, etc., as well as to the main pump side, the discharge pressure of the first subsidiary discharge port 54 is great, and therefore the pressure of the oil sent into the first subsidiary back pressure supply port 56 from the first subsidiary discharge port 54 is also high.

Therefore, a high pressure is propagated from the first subsidiary back pressure supply port 56 to the back pressure chamber 32. Consequently, the vanes 4 in the vane grooves 31 are pressed appropriately by a large pressing force, and the vanes 4 on the subsidiary pump side press against the inner circumference side surface 21 of the cam ring 2 with an appropriately large pressing force at all times, and the pump operates with good efficiency.

When the subsidiary pump side is switched to circulation, and the oil is in a state of circulating inside the subsidiary discharge circulation flow channel 93, then the discharge pressure from the first subsidiary discharge port 54 becomes smaller. Consequently, the pressure of the oil sent into the first subsidiary back pressure supply port 56 from the first subsidiary discharge port 54 becomes smaller, and the oil pressure propagated to the back pressure chambers 32 becomes small. As a result of this, the force pressing the vanes 4 from the back pressure chambers 32 on the subsidiary pump side becomes small and the pressing force between the tips of the vanes 4 and the inner circumference side surface 21 of the cam ring 2 also becomes small.

Due to the configuration described above, when the pump is operating, there is no extreme increase in the pressure in the back pressure chambers 32 of the rotor 3. The sliding resistance between the tips of the vanes 4 and the inner surface of the cam ring 2 decreases and it becomes possible to further decrease the drive torque. In order to ensure the discharge pressure of the main pump, which is one characteristic of the pump, the first main back pressure supply port 55 is formed through a range from the finish end position of the first subsidiary discharge port 54 to the start end position of the first subsidiary intake port 51 along the direction of rotation of the rotor 3, and hence the pumping characteristics do not decline.

This is because oil pressure is supplied at all times to the back pressure chambers 32 from the main pump side back pressure supply port (the first main back pressure supply port 55 and the second main back pressure supply port 65), in the whole range of the intake ports on the main pump side (the first main intake port 52 and the second main intake port 62), and therefore the tip portions of the vanes 4 are caused to make reliable contact with the inner circumference side surface 21 of the cam ring 2 at all times, and hence oil can be sucked in a reliable fashion.

According to the present invention, a high discharge pressure is ensured in the oil supplied to the equipment 96, such as the transmission or engine, while also being able to decrease the drive torque of the pump by reducing the propagation of the oil pressure to the first subsidiary back pressure supply port 56 and the second subsidiary back pressure supply port 66, when the discharge ports on the subsidiary pump side (the first subsidiary discharge port 54 and the second subsidiary discharge port 64) are in a circulating state, and hence the fuel consumption is improved.

In the second embodiment, it is possible to send out oil from the first subsidiary back pressure supply port to the first subsidiary discharge port without leaking to other portions. In the third embodiment, it is possible to send out a large volume of the oil passing from the first subsidiary back pressure supply port to the first subsidiary discharge port, simultaneously to other portions, and the back pressure applied to the vanes can be decreased immediately. In a fourth embodiment, it is possible to send out oil passing from the first subsidiary back pressure supply port to the first subsidiary discharge port, efficiently, to other portions. In fifth, sixth and seventh embodiments, when discharging the first subsidiary discharge port to the equipment side, the oil pressure in the back pressure chambers is raised, and by lowering the oil pressure during circulation, unnecessary torque is eliminated in operation of the vane pump and the pump efficiency can be improved.

What is claimed is:

1. A vane pump, comprising:

a pump unit including:

a rotor in which a plurality of vanes are slidably mounted in a radial direction;

a cam ring inside which the rotor is installed;

a first side member including first main and subsidiary intake ports and first main and subsidiary discharge ports along a circumferential direction on both sides in an axial direction of the cam ring; and a second side member including second main and subsidiary intake ports and second main and subsidiary discharge ports along the circumferential direction, wherein a first main back pressure supply port and a first subsidiary back pressure supply port are formed in a first sliding contact surface of the first side member, wherein the first main back pressure supply port is formed in a groove shape in the first sliding contact surface, wherein the first subsidiary back pressure supply port is configured so as to communicate with the first subsidiary discharge port, wherein a second main back pressure supply port and a second subsidiary back pressure supply port are formed in the second side member, wherein the second main back pressure supply port passes through the second side member in the axial direction, wherein the second subsidiary back pressure supply port is formed in the groove shape in a second sliding contact surface without passing through the second side member in the axial direction, and wherein all of back pressure chambers formed at inner ends in the radial direction of vane grooves of the rotor are encompassed by and communicate with one of the first main back pressure supply port and the first subsidiary back pressure supply port, and the first main back pressure supply port is formed through an angle exceeding 180 degrees, wherein, when the rotor is at or above a medium rotational speed, a flow channel is switched by a flow channel switching valve which is provided on a side of a subsidiary discharge channel, the subsidiary discharge channel is connected to the first subsidiary discharge port, oil flows from the subsidiary discharge channel into a subsidiary discharge circulation flow channel and assumes a circulating state on a subsidiary discharge side, the first subsidiary back pressure supply port of the first side member communicates with the first subsidiary discharge port and the first subsidiary back pressure supply port communicates with the back pressure chambers formed at inner ends in the radial direction of vane grooves of the rotor.

2. A vane pump, comprising:

a pump unit including:

a rotor in which a plurality of vanes are slidably mounted in a radial direction;

a cam ring inside which the rotor is installed;

a first side member including first main and subsidiary intake ports and first main and subsidiary discharge ports along a circumferential direction on both sides in an axial direction of the cam ring; and a second side member including second main and subsidiary intake ports and second main and subsidiary discharge ports along the circumferential direction, wherein a first main back pressure supply port and a first subsidiary back pressure supply port are formed in a first sliding contact surface of the first side member, wherein the first main back pressure supply port is formed in a groove shape in the first sliding contact surface, wherein the first subsidiary back pressure supply port is configured so as to communicate with a first subsidiary discharge port, wherein a second main back pressure supply port and a second subsidiary back pressure supply port are formed in the second side member, wherein the second main back pressure supply port passes through the second side member in the axial direction, wherein the second subsidiary back pressure supply port is formed in the groove shape in a second sliding contact surface without passing through the second side member in the axial direction, and wherein the first main back pressure supply port is formed near a center of a diameter of the first side member so as to cover a range along a direction of a rotation of the rotor from a vicinity of a virtual line which links a finish end of the first subsidiary discharge port with the center of the diameter of the first side member, to a vicinity of a virtual line which links a start end of the first subsidiary intake port with the center of the diameter, and at a position where the back pressure chambers of the rotor are encompassed thereby, wherein, when the rotor is at or above a medium rotational speed, a flow channel is switched by a flow channel switching valve which is provided on a side of a subsidiary discharge channel, the subsidiary discharge channel is connected to the first subsidiary discharge port, oil flows from the subsidiary discharge channel into a subsidiary discharge circulation flow channel and assumes a circulating state on a subsidiary discharge side, the first subsidiary back pressure supply port of the first side member communicates with the first subsidiary discharge port and the first subsidiary back pressure supply port communicates with the back pressure chambers formed at inner ends in the radial direction of vane grooves of the rotor.

3. A vane pump, comprising:

a pump unit including:

a rotor in which a plurality of vanes are slidably mounted in a radial direction;

a cam ring inside which the rotor is installed;

a first side member including first main and subsidiary intake ports and first main and subsidiary discharge ports along a circumferential direction on both sides in an axial direction of the cam ring; and a second side member including second main and subsidiary intake ports and second main and subsidiary discharge ports along the circumferential direction, wherein a first main back pressure supply port and a first subsidiary back pressure supply port are formed in a first sliding contact surface of the first side member, wherein the first main back pressure supply port is formed in a groove shape in the first sliding contact surface, wherein the first subsidiary back pressure supply port is configured so as to communicate with the first subsidiary discharge port, wherein a second main back pressure supply port and a second subsidiary back pressure supply port are formed in the second side member, wherein the second main back pressure supply port passes through the second side member in the axial direction, wherein the second subsidiary back pressure supply port is formed in the groove shape in a second sliding contact surface without passing through the second side member in the axial direction, and wherein, when the rotor is at or above a medium rotational speed, a flow channel is switched by a flow channel switching valve which is provided on a side of a subsidiary discharge channel, the subsidiary discharge channel is connected to the first subsidiary discharge port, oil flows from the subsidiary discharge channel into a subsidiary discharge circulation flow channel and assumes a circulating state on a subsidiary discharge side, the first subsidiary back pressure supply port of the first side member communicates with the first subsidiary discharge port and the first subsidiary back pressure supply port communicates with back pressure chambers formed at inner ends in the radial direction of vane grooves of the rotor.

4. The vane pump according to claim 3, wherein the first subsidiary back pressure supply port has the groove shape, a through hole is formed along the axial direction in a portion of the groove shape, and the through hole communicates with the first subsidiary discharge port via an expulsion groove which is formed in a surface on an opposite side to the first sliding contact surface.

5. The vane pump according to claim 3, wherein the first subsidiary back pressure supply port passes through the first side member in the axial direction thereof, to communicate with the first subsidiary discharge port via an expulsion groove which is thrilled in a surface on an opposite side to the first sliding contact surface.

6. The vane pump according to claim 3, wherein the first subsidiary back pressure supply port has the groove shape, and an expulsion hole flow channel, which communicates between a portion of the groove shape and an intermediate location of the first subsidiary discharge port in the axial direction, is formed.

7. The vane pump according to claim 3, wherein, when sending oil to an equipment from the first subsidiary discharge port, oil pressure supplied to the first subsidiary back pressure supply port from the first subsidiary discharge port is high, and the oil pressure is low during circulation.

8. The vane pump according to claim 3, wherein a back pressure chamber of the rotor is configured so as to communicate with the first subsidiary back pressure supply port or the first main back pressure supply port.

9. The vane pump according to claim 3, wherein the first subsidiary back pressure supply port is formed through a range from a vicinity of a virtual line linking a start end of the first subsidiary intake port with a center of a diameter of the first side member to a vicinity of a virtual line linking a finish end of the first subsidiary discharge port with the center of diameter of the first side member along a direction of a rotation of the rotor.

10. The vane pump according to claim 3, wherein the back pressure chambers formed at the inner ends in the radial direction of the vane grooves of the rotor are encompassed by and communicate with one of the first main back pressure supply port and the first subsidiary back pressure supply port.

11. The vane pump according to claim 10, wherein the first main back pressure supply port is formed through an angle exceeding 180 degrees.

12. The vane pump according to claim 3, wherein the first main back pressure supply port is formed through an angle exceeding 180 degrees.

13. The vane pump according to claim 3, wherein the first main back pressure supply port is formed near a center of a diameter of the first side member to cover a range along a direction of a rotation of the rotor from a vicinity of a virtual line which links a finish end of the first subsidiary discharge port with the center of the diameter of the first side member, to a vicinity of a virtual line which links a start end of the first subsidiary intake port with the center of the diameter, and at a position where the back pressure chambers of the rotor are encompassed thereby.

* * * * *